US008707565B2

(12) United States Patent
Muccino et al.

(10) Patent No.: US 8,707,565 B2
(45) Date of Patent: Apr. 29, 2014

(54) BLADE HOLDER

(76) Inventors: Alfredo Muccino, San Jose, CA (US); Scot Herbst, San Jose, CA (US); Alan Regala, Seattle, WA (US)

( * ) Notice: Subject to any disclaimer, the term of this patent is extended or adjusted under 35 U.S.C. 154(b) by 535 days.

(21) Appl. No.: 12/908,128

(22) Filed: Oct. 20, 2010

(65) Prior Publication Data

US 2011/0088264 A1 Apr. 21, 2011

Related U.S. Application Data

(60) Provisional application No. 61/279,516, filed on Oct. 21, 2009.

(51) Int. Cl.
*B26B 3/06* (2006.01)

(52) U.S. Cl.
USPC ..... 30/162; 30/335; 30/125

(58) Field of Classification Search
USPC ..... 30/162, 335, 337, 125
See application file for complete search history.

(56) References Cited

U.S. PATENT DOCUMENTS

| | | | | |
|---|---|---|---|---|
| 5,495,670 | A * | 3/1996 | Quinn | 30/162 |
| 6,192,589 | B1 * | 2/2001 | Martone et al. | 30/125 |
| 6,886,257 | B2 * | 5/2005 | Chih | 30/125 |
| 7,156,231 | B1 * | 1/2007 | Austria | 206/355 |
| 2002/0029482 | A1 * | 3/2002 | Peyrot et al. | 30/162 |
| 2010/0293791 | A1 * | 11/2010 | Mueller | 30/162 |
| 2011/0119927 | A1 * | 5/2011 | Mueller | 30/162 |

* cited by examiner

*Primary Examiner* — Omar Flores Sanchez

(74) *Attorney, Agent, or Firm* — James M Smedley LLC; James M. Smedley, Esq.

(57) ABSTRACT

Specific embodiments of the present invention are directed to blade holders, which provide an easier method to cut by way of including a guide incorporated into the handle. This guide rests upon the surface to be cut, leading the cutting blade. Furthermore, the leading end of the tool is blunt, which is safer than leading with a sharp edge. In specific embodiments, the handle is of such a shape that the user can pull the tool straight back to cut, allowing the hand to rest in a more neutral and ergonomic position.

15 Claims, 8 Drawing Sheets

BLADE HOLDER

CROSS REFERENCE TO RELATED APPLICATIONS

This application claims the benefit of U.S. Provisional Patent Application No. 61/279,516 Filed Oct. 21, 2009, the entire disclosure of which is incorporated herein by reference.

FIELD OF THE INVENTION

The present invention relates to a blade holder, similar in nature to a utility knife, with enhanced safety and performance properties.

BACKGROUND OF THE INVENTION

Shipping and receiving personnel and others in industrial, commercial or other environments commonly spend hours throughout the day opening and/or breaking down boxes. Utility knives are commonly used to cut tape of these boxes as well as cut the material of the boxes themselves (e.g., corrugated paperboard). The typical utility knife has a long exposed blade which poses a significant danger to the user and those in the vicinity of the user.

Injuries caused by utility knife accidents can be painful and costly, both to the user of the utility knife and to an employer.

There has been a long felt need from the users of utility knives to have a safer and more effective tool for the opening and breaking down of boxes. Thus, there remains a need in the art for a safe and effective tool for the opening and breaking down boxes.

SUMMARY OF THE INVENTION

The present invention provides a blade holder that is comprised of a guide incorporated into a handle attached to the portion of the invention that holds a blade for cutting. In this embodiment, the guide may rest upon a cutting surface and lead the blade portion.

In one embodiment in accordance with the present invention, the blade does not protrude from the device by more than 8 mm. This limited protrusion decreases the likelihood of an accidental injury in comparison to standard utility knives that may have blades that protrude as much as 27 mm or more.

In one embodiment in accordance with the present invention, the handle guide is positioned relative to the blade such that the guide must be positioned flat on the cutting surface in order for the blade to be fully inserted into or through the cutting material.

In one embodiment in accordance with the present invention, the combination of the handle guide and minimally protruding blade forces a user of the blade holder to operate with a safe cutting motion.

In one embodiment in accordance with the present invention, the blade is made of zirconium oxide, which is sharper than standard steel blades and stays sharper much longer than standard steel blades.

In one embodiment in accordance with the present invention, the thickness of the blade is 1.3 mm or less.

In one embodiment in accordance with the present invention, the blade contains a notch feature centered in the blade which operates to stabilize the blade inside the tool. The notch may be positioned such that the blade is symmetric and can be used on both sides.

In one embodiment in accordance with the present invention, the blade has rounded tips for additional safety. Alternatively, the blades could come to a point or be chamfered.

In one embodiment in accordance with the present invention, The guide portion of the tool may further be comprised of a compartment for storage of additional blades. The compartment may be comprised of a cantilevered beam with a mating feature that pairs with a notch in the additional blades.

In one embodiment in accordance with the present invention, the blade holder may be comprised of plastic or metal or any combination thereof.

DETAILED DESCRIPTION OF THE INVENTION

Figure 1:
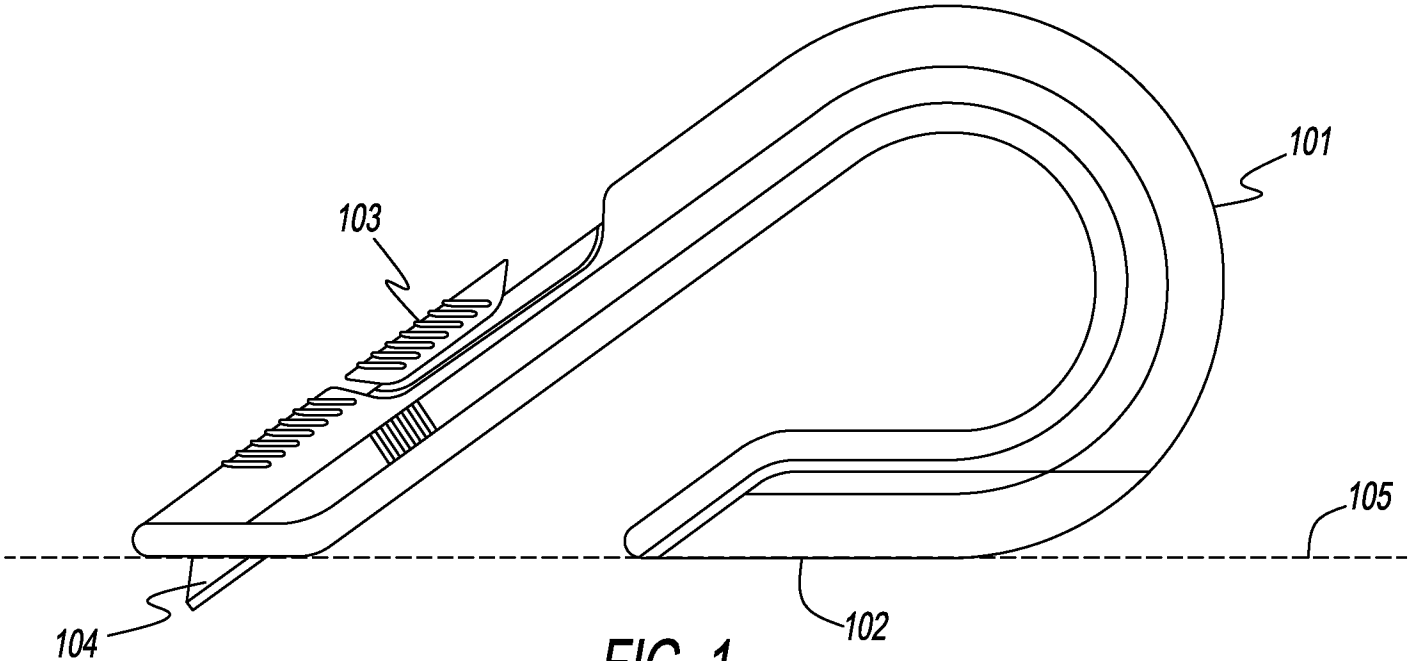
FIG. 1 is a drawing of a front view of a blade holder in accordance with an embodiment of the present invention.
Figure 2:
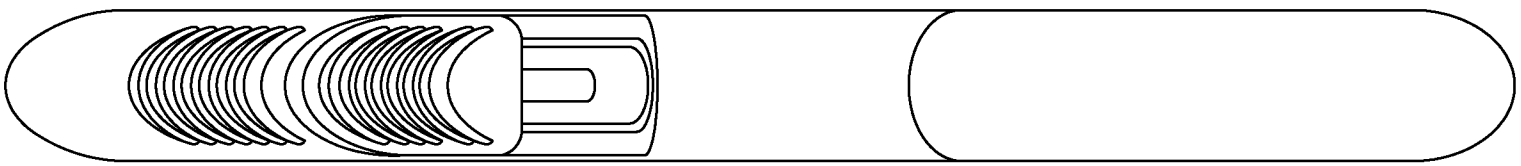
FIG. 2 is a drawing of a top view of a blade holder in accordance with an embodiment of the present invention.

Referring to FIG. 1, there is shown a blade holder according to an embodiment of the present invention. The blade holder is comprised of a handle 101, a guide portion 102 and a trailing edge. The trailing edge is comprised of a blade actuator 103 and a blade 104. Together, the guide portion 102 and at least a portion of the handle 101 form a leading edge. FIG. 1 shows a blade holder that has an ergonomically designed curved handle 101. One of ordinary skill in the art would appreciate that the handle 101 could be designed in any manner of shapes, and embodiments of the present invention are contemplated for use with any handle shape.

One of the main features of the blade holder is the guide portion 102. The guide portion 102 of the blade holder provides a guide surface that is intended to in contact a cutting surface 105 of a material to be cut. According to an embodiment of the present invention, the guide portion 102 will rest flat on the cutting surface 105 of the material to be cut in a manner such that the guide portion 102 leads the blade 104 of the blade holder when making a cut.

According to an embodiment of the present invention, the guide portion 102 and handle portion 101 of the blade holder are blunt and comprise a leading edge that leads the trailing edge, also known as a blade portion of the blade holder, along a cutting pathway. In this manner, cuts are made with a blunt leading edge facing outward in the cutting pathway. When cuts are made with a blunt leading edge, the likelihood of injury to a user or any bystanders is substantially reduced as the sharp blade portion of the blade holder is safely trailing the blunt leading edge.

According to an embodiment of the present invention, the handle 101 and guide portion 102 of the blade holder may be made from plastic, metal, ceramics or any combination thereof. One of ordinary skill in the art would appreciate that numerous materials may be used in the construction of a blade holder in accordance with embodiments of the present invention, and embodiments of the present invention are contemplated for use with any number of materials.

On the trailing edge of the blade holder is a blade actuator 103. According to an embodiment of the present invention, the blade actuator 103 is comprised of a sliding mechanism received upon the trailing edge of the blade holder. The blade actuator 103 is responsible for the extension and retraction of the blade 104. In the retracted state, the blade 104 is fully received within the trailing edge of the blade holder. In the extended state, the blade 104 extends out of the trailing edge.

According to an embodiment of the present invention, There may be more than one extended state for the blade 104. For example, a blade holder may be comprised of extended states that create a 4 mm or an 8 mm protrusion of the blade 104 from the trailing edge of the blade holder. In this manner, the blade 104 is capable of being extended to the minimum length necessary to cut a particular material. This feature further increases the safety of blade holders in accordance with embodiments of the present invention.

In the retracted state, as noted above, the blade 104 is fully enclosed within the trailing edge of the blade holder. In this state, the blade holder is safe and easy to transport and store.

Figure 3:
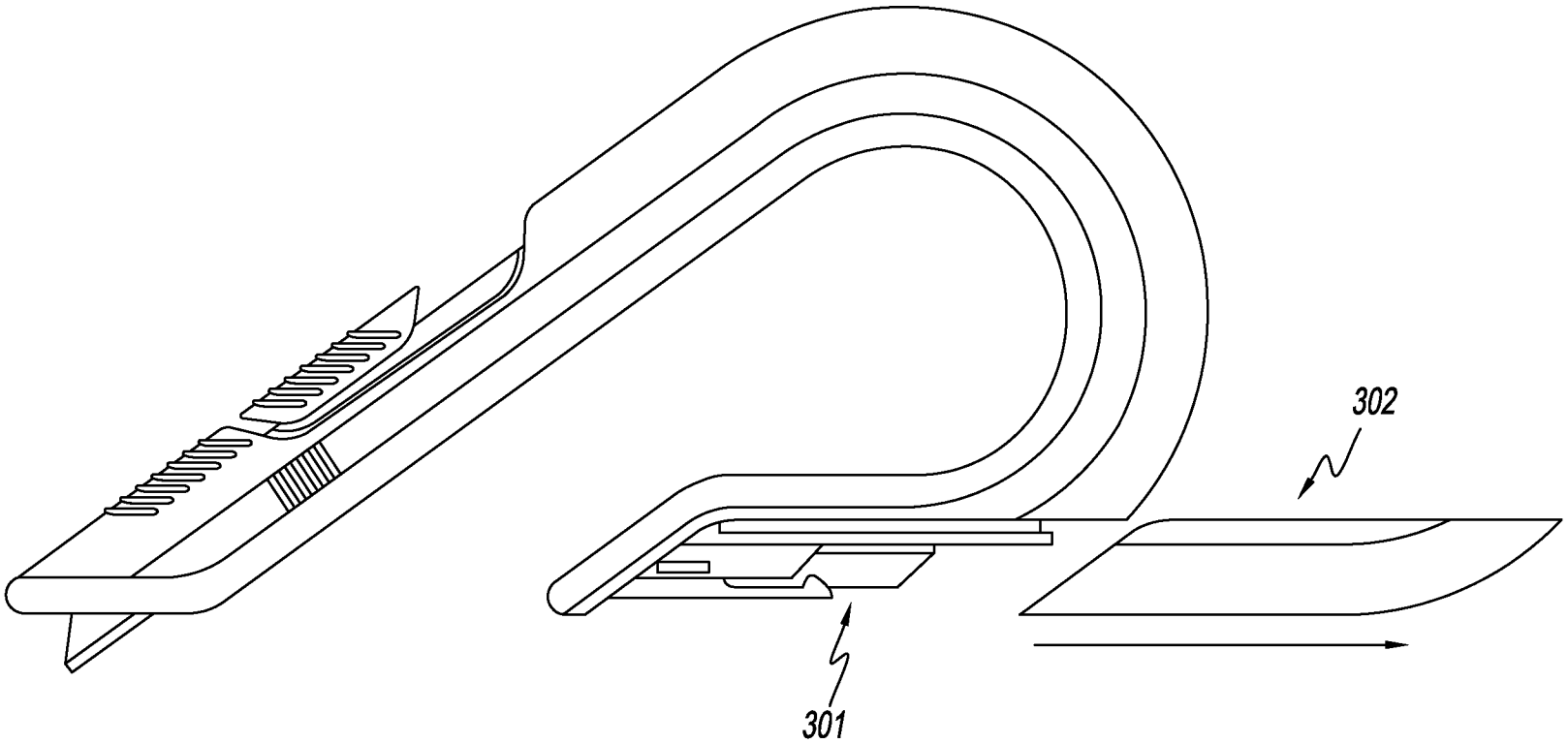
FIG. 3 is a drawing of a front view of a blade holder with a blade storage compartment in accordance with an embodiment of the present invention.

Referring now to FIG. 3, there is shown a blade storage compartment 301 according to an embodiment of the present invention. The glide portion 102 of the blade holder may be comprised of a blade storage door 302 movably connected to a rail or other retention mechanism. The blade storage door 302 may be opened to reveal a blade storage compartment 301 intended for the safe storage of additional blades. It should be noted that even though FIG. 3 shows a blade storage door 302 sliding parallel with the plane of the glide portion 102 of the blade holder, one of ordinary skill in the art would appreciate that there are numerous ways in which the blade storage door 302 may be movably connected to the glide portion 102, and embodiments of the present invention are contemplated for use with any number of connection methods.

Figure 4:
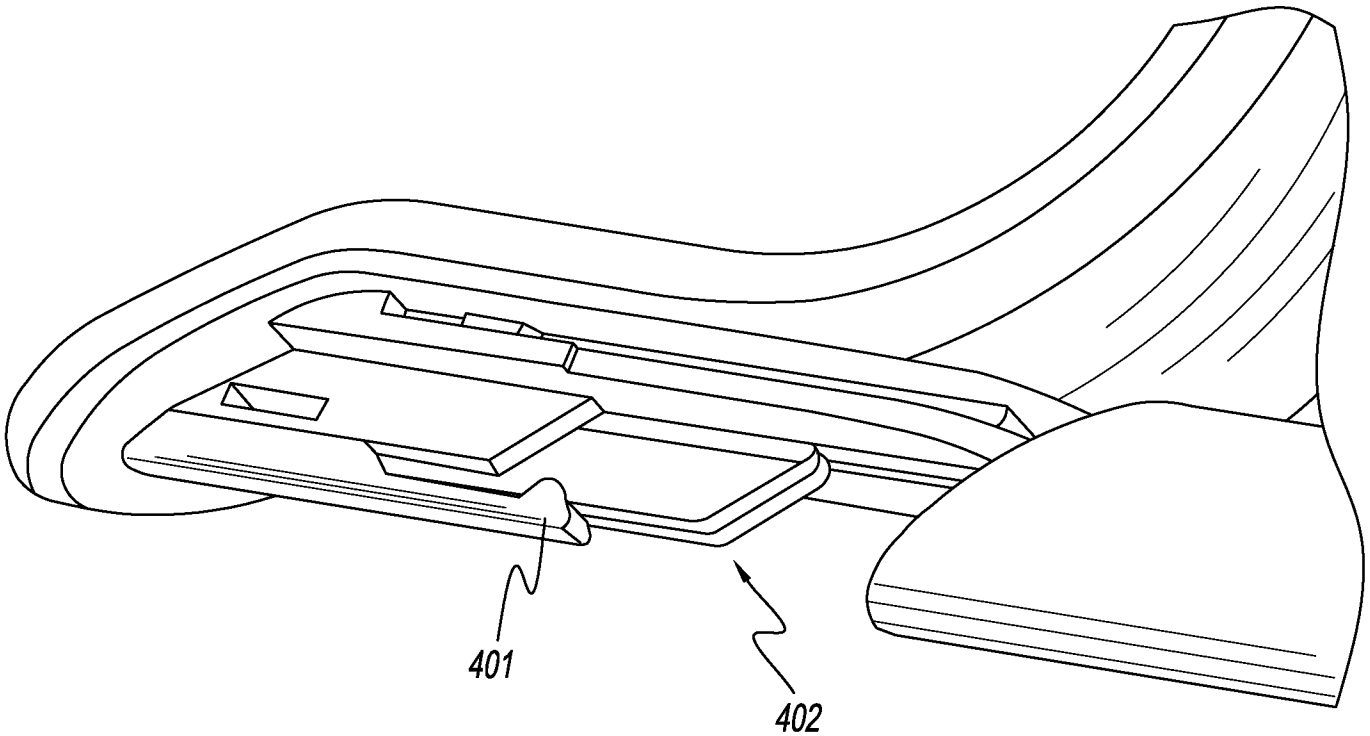
FIG. 4 is a drawing of a view of a cantilevered beam with mating feature in accordance with an embodiment of the present invention.

Referring now to FIG. 4, there is shown a blade storage compartment according to an embodiment of the present invention. Inside the blade storage compartment is a cantilevered beam with a mating feature 401 that functions to hold additional blades 402 in the blade storage compartment. Access to the additional blades 402 is provided such that a user may grasp the sides of the additional blade(s) 402 to safely remove them from the blade storage compartment. Advantageously, having additional blades stored within a blade storage compartment functions to make users of the blade holder more efficient as replacing a dull blade is simplified.

Figure 5:
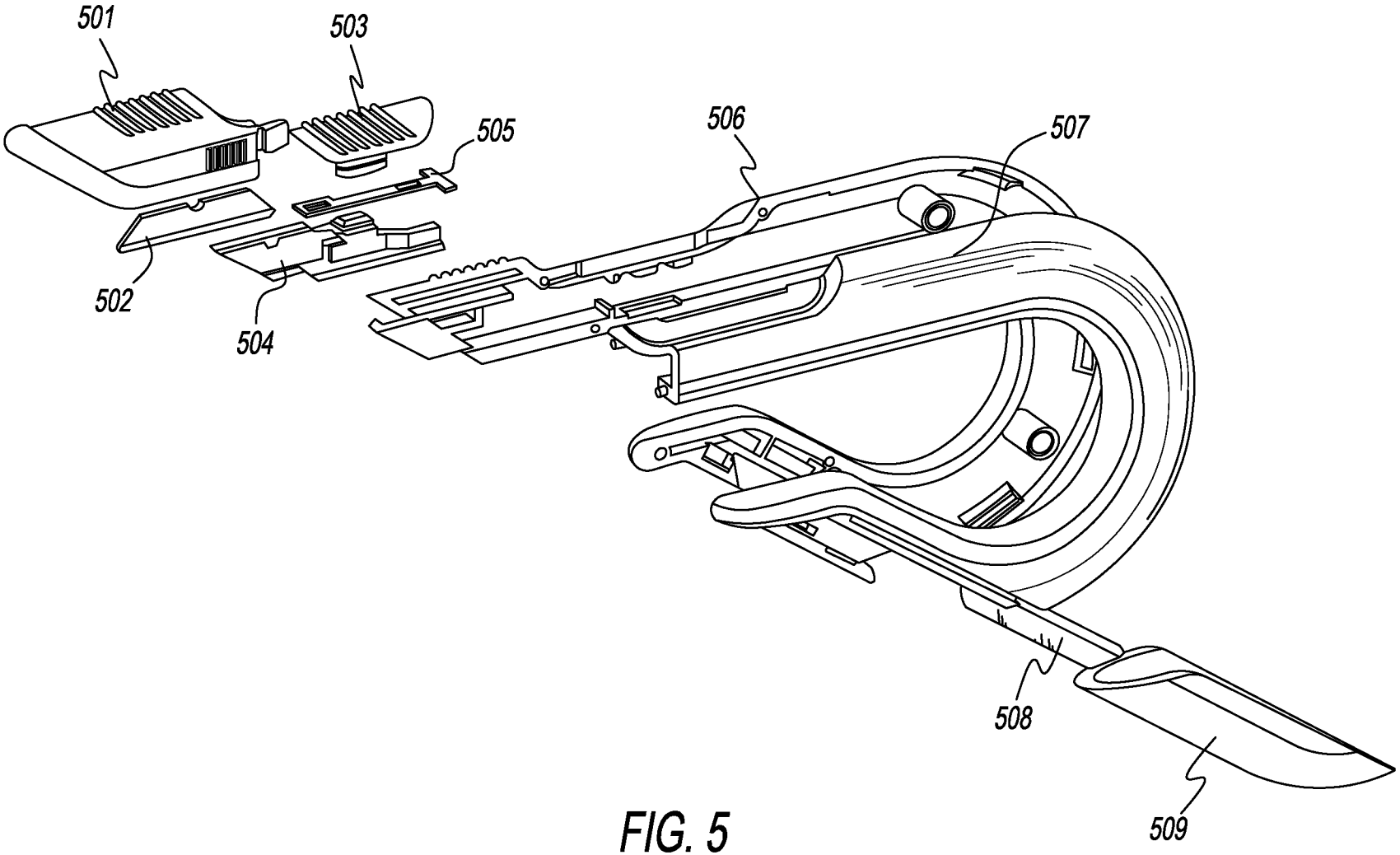
FIG. 5 is a drawing of an exploded view of a blade holder in accordance with an embodiment of the present invention.

Referring now to FIG. 5, there is shown an exploded view of a blade holder according to an embodiment of the present invention. The blade holder of FIG. 5 has a trailing edge comprised of a blade cover 501, blade 502, blade actuator 503, blade retainer 504, spring 505, body-right section 506, body-left section 507 and a leading edge comprised of a guide portion 508 containing a blade storage compartment. The blade storage compartment is comprised revealed by way of a movable blade storage door 509 as described in detail above.

Figure 6:
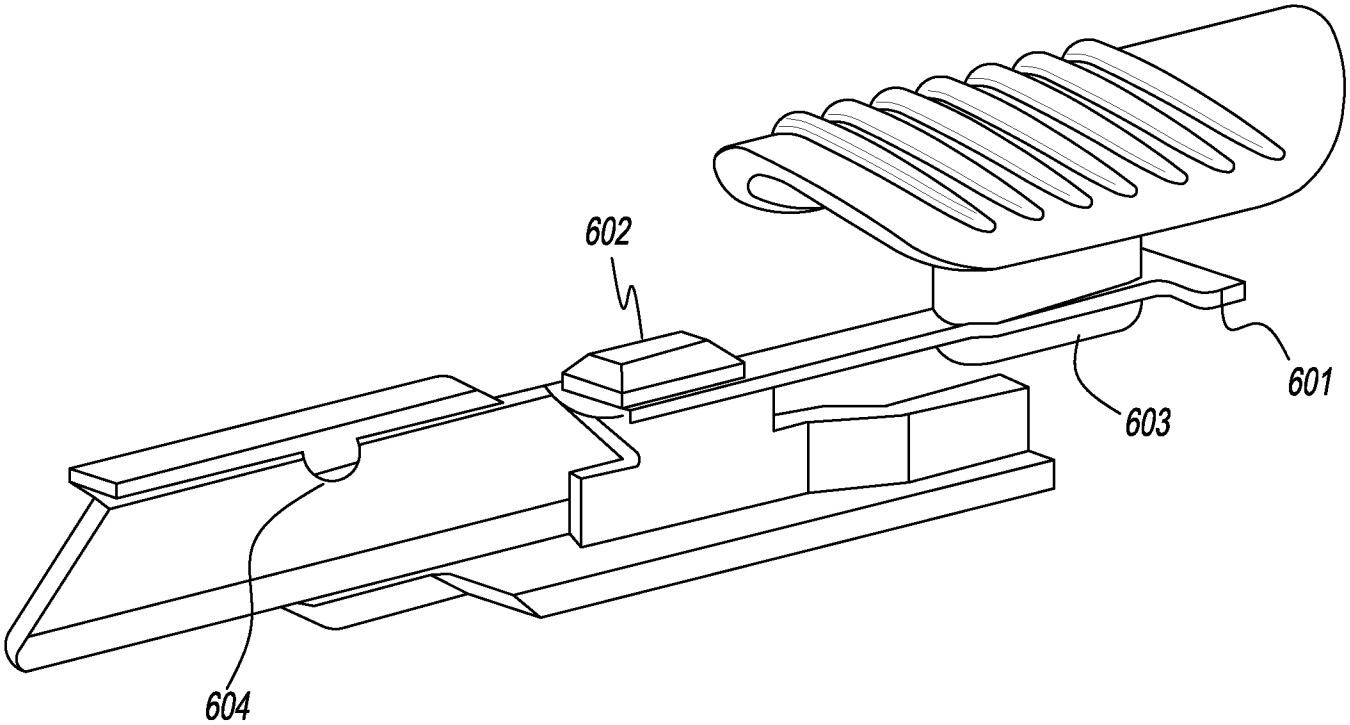
FIG. 6 is a drawing of a blade sub-assembly in accordance with an embodiment of the present invention.

Referring now to FIG. 6, there is shown a blade sub-assembly which is at least partially received within said trailing edge of a blade holder in accordance with an embodiment of the present invention. Blade sub-assembly is comprised of a spring 601, a blade retainer 602 attached to said spring 601 and a blade actuator 603 attached to said spring 601. In an exemplary embodiment, the spring 601 has a T tab that aids in controlling the extension and retraction of the blade 604 through a blade slot. Blade retainer 602 receives a blade 604 and holds said blade 604 in place during normal operation of the blade holder.

Figure 7:
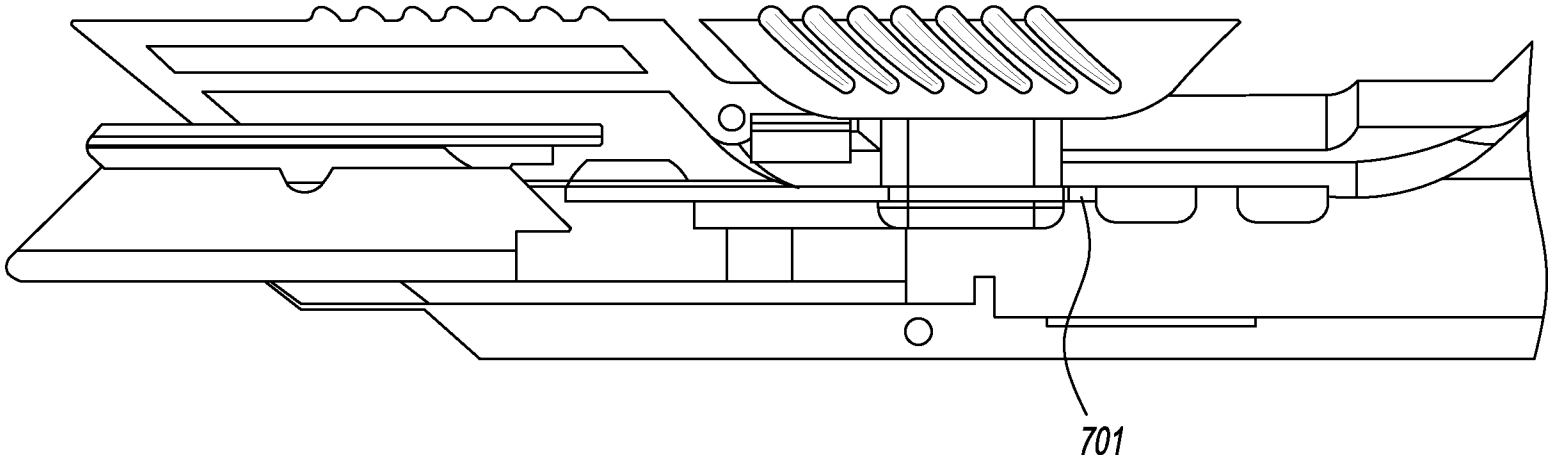
FIG. 7 is a drawing of a blade sub-assembly in accordance with an embodiment of the present invention.

Referring now to FIG. 7, there is shown a body-right portion of a blade sub-assembly in accordance with an embodiment of the present invention. As shown, the T tab of the spring lines up with notches 701 in the body of the trailing edge of the blade holder. The T tab may be received in any one of the notches 701, allowing for the blade to be extended to set distances. For example, when fully extended, the T tab may be received in a notch 701 that is set in such a manner that a blade retained in the blade retainer extends exactly 8 mm beyond the exterior portion of the blade slot.

In order to move the spring from one notch 701 to another, a user may push down on the blade actuator, causing the spring to be lowered out of the receiving notch 701 into a channel that allows movement from one notch 701 to another. Once the blade actuator is depressed, the user may slide the blade actuator forward or backward to extend or retract the blade. Once the desired extension or retraction is reached, the blade actuator may be released and the T section of the spring will once again be received within a notch 701 most closely related to the desired extension or retraction position.

Figure 9:
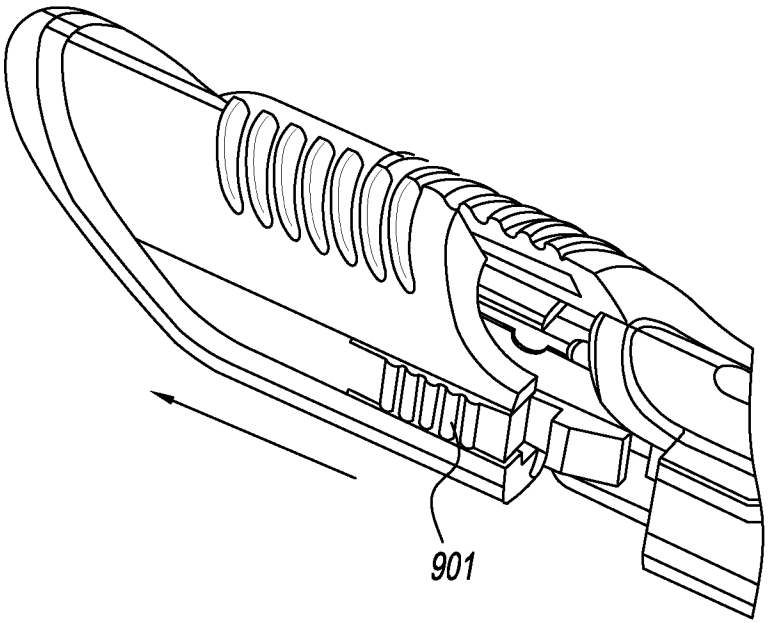
FIG. 9 is a drawing of a removable blade replacement cover in an open position in accordance with an embodiment of the present invention.
Figure 8:
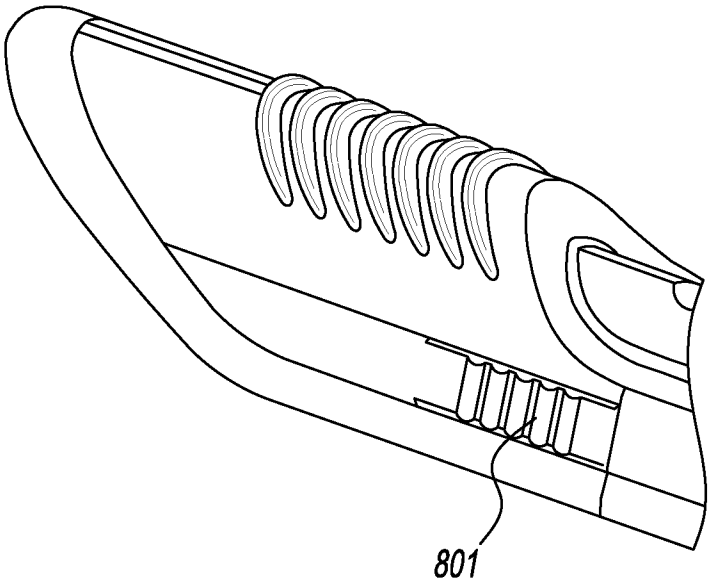
FIG. 8 is a drawing of a removable blade replacement cover in a closed position in accordance with an embodiment of the present invention.

Referring now to FIGS. 8 and 9, there is shown a body-left portion of a blade sub-assembly in accordance with an embodiment of the present invention. A user may push in on a cover level arm 801 located on the side of a body-left portion the blade sub-assembly in order to slide a movable cover forward allowing easy access to the interior portion of the blade sub-assembly for blade holder maintenance or blade replacement. It should be noted that even though FIG. 8 shows a movable cover 901 sliding parallel with the plane of the blade sub-assembly portion of the blade holder, one of ordinary skill in the art would appreciate that there are numerous ways in which the moveable cover 901 may be movably connected to the blade sub-assembly, and embodiments of the present invention are contemplated for use with any number of connection methods.

Furthermore, although FIGS. 7-9 show body-right and body-left portions of the blade sub-assembly in accordance with one embodiment of the present invention, these body portions may be reversed allowing for the body-right components shown in FIG. 7 to be located on a body-left portion of a blade holder and the body-left components shown in FIGS. 8 and 9 to be located on a body-right portion of a blade holder. One of ordinary skill in the art would appreciate that any of the components shown in FIGS. 7-9 could be located on either a body-right or body-left portion of a blade sub-assembly, and embodiments of the present invention are contemplated for use with the components located on either portion of a blade sub-assembly.

Figure 11:
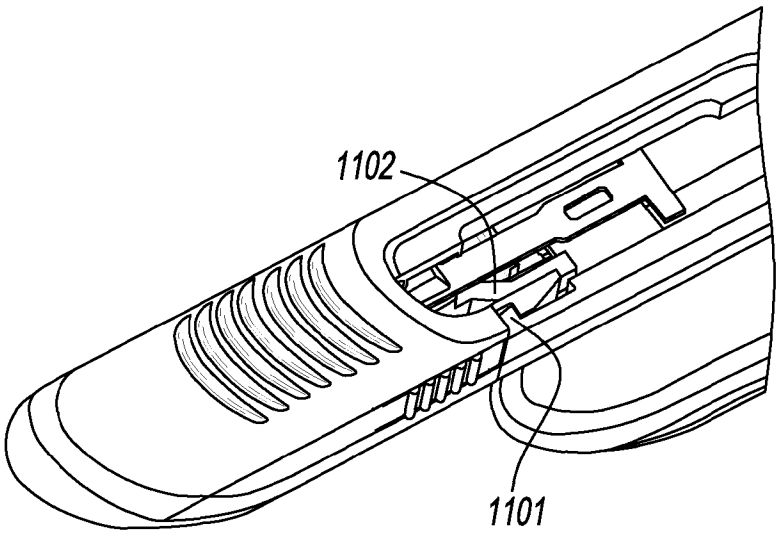
FIG. 11 is a drawing of an internal portion of a body-right part with a blade in a non-fully refracted position in accordance with an embodiment of the present invention.
Figure 10:
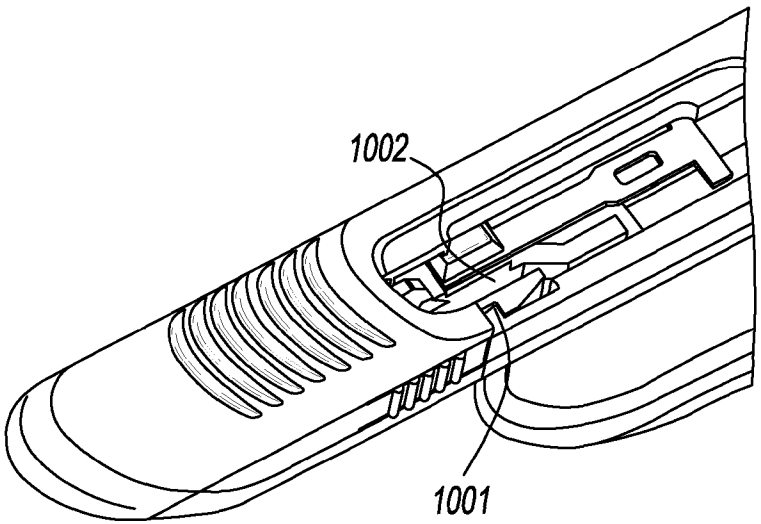
FIG. 10 is a drawing of an internal portion of a body-right part with a blade in a fully refracted position in accordance with an embodiment of the present invention.

Referring now to FIGS. 10 and 11, there is shown an interior portion of a blade sub-assembly in accordance with an embodiment of the present invention. A cover lever arm 1001 is shown, mated with a body-right portion of the blade sub-assembly. The mating of the cover lever arm 1001 to the body-right portion of the blade sub-assembly prevents the body-right portion from unintentionally sliding off. In order to remove the body-right portion of the blade sub-assembly, the user must push in the cover lever arm 1001 to release a catch.

According to an embodiment of the present invention, as an additional safety feature, the cover lever arm 1001 may be prevented from releasing the catch unless the blade is in a fully refracted position. This is accomplished by designing the cover lever arm 1001 in such a manner that it may only release the catch when there is sufficient space 1002 behind the cover lever arm 1001 to release the catch and the only time sufficient space exists is when the blade is in the fully refracted position. In this manner, as shown in FIG. 11, when the blade is extended, there is no longer sufficient space 1102 for the cover lever arm 1101 to release the catch and allow for the removal of the body-right portion of the blade sub-assembly. This feature increases safety by preventing the disassembly of the blade holder when the blade holder is in an operational state (i.e., the blade is extended).

Turning now to the operation of a blade holder in accordance with an embodiment of the present invention. In use, a blade holder allows for the blunt leading edge and guide to maintain contact with a material to be cut and the trailing edge to follow a cutting pathway as directed by the user. In this manner, the blade holder creates a ergonomic use that promotes safety. By leading with a blunt leading edge, any sudden release in tension that is created at the end of a cutting pathway would cause the blunt leading edge to careen forward, reducing the likelihood of slashing or piercing wounds resulting from losing control of the blade holder.

Furthermore, since the guide helps maintain optimal cutting distance through its contact with the cutting surface, the amount that a blade must extend from the blade holder is significantly reduced. According to an exemplary embodiment in accordance with the present invention, a blade may be restricted from extending further than 8 mm from the exterior portion of the blade slot.

According to an exemplary embodiment in accordance with the present invention, the blade may be made of zirconium oxide, a ceramic material. Zirconium oxide blades are sharper than their steel equivalents and stay sharper for much longer. One of ordinary skill in the art would appreciate that blades may be made from any number of materials, and embodiments of the present invention are contemplated for use with any number of types of blades.

According to an exemplary embodiment in accordance with the present invention, the blade may contain a notch feature centered in the blade. This notch feature stabilizes the blade within the blade sub-assembly and allows for accurate cuts and prevents unwanted release of the blade. Additionally, the centered notch feature provides symmetry and allows for both sides of the blades to be used. One of ordinary skill in the art would appreciate that any number of blade designs may be used with blade holders in accordance with embodiments of the present invention, and embodiments of the present invention are contemplated for use with any number of blade designs.

According to an exemplary embodiment in accordance with the present invention, the blade may have rounded tips for additional safety. Rounding the tips of the blades would reduce the risk of puncture wounds resulting from improper use or handling of a blade holder or blade. Alternatively, the blades may have chamfered or pointed tips. One of ordinary skill in the art would appreciate that any number of blade tip types may be used with embodiments of the present invention, and embodiments of the present invention are contemplated for use with blades with any type of tip.

According to an embodiment of the present invention, the trailing edge portion of the blade holder may be connected to the handle portion via a connection means. Connections means may include, but is not limited to, a hinge. The connection means allows for the trailing edge portion of the blade holder to collapse towards the leading edge of the blade holder in order to create a smaller form factor, allowing for safe and easy transport of the device. Other advantages of this collapsed state include the potential for the device to be secured to a tool belt, tool kit, a pair of pants, a belt loop or an ordinary belt.

According to an embodiment of the present invention, the trailing edge portion of the blade holder may be comprised of a standard utility knife. In this embodiment, a standard utility knife is removably connected to the handle and operates as a trailing edge. A standard utility knife may be connected to the handle via a hinge or other connection means. One of ordinary skill in the art would appreciate that any number of connection means may be used with embodiments of the present invention, and embodiments of the present invention are contemplated for use with any connection means.

In the aforementioned embodiment, using a standard utility knife as the trailing edge portion of a blade holder, in accordance with embodiments of the present invention, allows standard utility knifes to receive some or all of the safety benefits of having a leading edge with a guide portion as previously described.

It is understood that the above-described embodiments are illustrative of only a few of the many possible specific embodiments, which can represent applications of the invention. Numerous and varied other arrangements can be made by those skilled in the art without departing from the spirit and scope of the invention.

The invention claimed is:

1. A blade holder, comprising:

a handle;

a leading edge extending from said handle;

a guide connected to said leading edge wherein said guide is adapted to maintain contact with a cutting surface, wherein said guide is further comprised of a blade storage compartment configured to store replacement blades, wherein said blade storage compartment is further comprised of a cantilevered beam configured to secure said replacement blades in said blade storage compartment, wherein said cantilevered beam is further comprised of a mating feature that is integrally formed at the distal end of said cantilevered beam, wherein said mating feature is configured to detachably engage with a notch formed in each of said replacement blades;

a trailing edge extending from said handle in a direction substantially opposite from said leading edge;

a blade slot positioned within said trailing edge such that an exterior opening of said blade slot is parallel with said guide;

a blade retractably positioned within said blade slot; and a blade actuator wherein said blade actuator controls the extension and retraction of said blade.

2. The blade holder according to claim 1 wherein said blade is completely contained inside said trailing edge when said blade is in a retracted state.

3. The blade holder according to claim 1 wherein said blade extends a set distance beyond said exterior opening of said blade slot when said blade is in an extended state.

4. The blade holder according to claim 1 wherein said blade is made of zirconium oxide.

5. The blade holder according to claim 1 wherein said trailing edge is further comprised of a slidable body portion that allows for the replacement of said blade.

6. The blade holder according to claim 5 wherein said trailing edge is further comprised of a cover lever arm that prevents movement of said slidable body portion unless said blade is fully retracted.

7. The blade holder according to claim 1 wherein said trailing edge is attached to said handle via a connection means.

8. The blade holder according to claim 7 wherein said connection means allows said trailing edge of said blade holder to collapse towards the leading edge of said blade holder.

9. A blade holder, comprising:

a handle;

a leading edge extending from said handle;

a guide connected to said leading edge wherein said guide is adapted to maintain contact with a cutting surface, wherein said guide is further comprised of a blade storage compartment configured to store replacement blades, wherein said blade storage compartment is further comprised of a cantilevered beam configured to secure said replacement blades in said blade storage compartment, wherein said cantilevered beam is further comprised of a mating feature that is integrally formed at the distal end of said cantilevered beam, wherein said mating feature is configured to detachably engage with a notch formed in each of said replacement blades; and a connection means connected to said handle in a direction substantially opposite from said leading edge, wherein said connection means is designed to removably receive a utility knife.

10. The blade holder according to claim 8 wherein said connection means is a hinge.

11. The blade holder according to claim 9 wherein said hinge allows said trailing edge of said blade holder to collapse towards the leading edge of said blade holder.

12. A blade holder, comprising:

a handle;

a guide connected to said handle wherein said guide is adapted to maintain contact with a cutting surface, wherein said guide is further comprised of a blade storage compartment configured to store replacement blades, wherein said blade storage compartment is further comprised of a cantilevered beam configured to secure said replacement blades in said blade storage compartment, wherein said cantilevered beam is further comprised of a mating feature that is integrally formed at the distal end of said cantilevered beam, wherein said mating feature is configured to detachably engage with a notch formed in each of said replacement blades;

a blade portion extending from said handle in a direction substantially opposite from said guide;

a blade slot positioned within said blade portion such that an exterior opening of said blade slot is parallel with said guide;

a blade retractably positioned within said blade slot; and a blade actuator wherein said blade actuator controls the extension and retraction of said blade.

13. The blade holder according to claim 11 wherein said blade extends a set distance beyond said exterior opening of said blade slot when said blade is in an extended state.

14. The blade holder according to claim 11 wherein said guide is further comprised of a blade storage compartment.

15. The blade holder according to claim 11 wherein said trailing edge is attached to said handle via a connection means.

* * * * *